US007753224B2

(12) United States Patent
Cai

(10) Patent No.: US 7,753,224 B2
(45) Date of Patent: Jul. 13, 2010

(54) CUP LID WITH SLIDE CLOSURE

(75) Inventor: Liming Cai, West Chester, PA (US)

(73) Assignee: DOPACO, Inc., Exton, PA (US)

( * ) Notice: Subject to any disclaimer, the term of this patent is extended or adjusted under 35 U.S.C. 154(b) by 740 days.

(21) Appl. No.: 11/513,327

(22) Filed: Aug. 31, 2006

(65) Prior Publication Data

US 2008/0073342 A1 Mar. 27, 2008

(51) Int. Cl.

| | |
|---|---|
| ***B65D 41/56*** | (2006.01) |
| ***B65D 51/00*** | (2006.01) |
| ***B65D 43/12*** | (2006.01) |
| ***B65D 43/20*** | (2006.01) |
| ***B65D 41/16*** | (2006.01) |

(52) U.S. Cl. ..... 220/254.9; 220/212; 220/345.1; 220/715; 220/780

(58) Field of Classification Search ..... 220/212, 220/226, 254.9, 345.1–345.4, 350, 713, 715, 220/719, 780; D7/509, 511, 900
See application file for complete search history.

(56) References Cited

U.S. PATENT DOCUMENTS

| | | | | |
|---|---|---|---|---|
| 2,574,612 | A | 11/1951 | Barnes | |
| 2,745,586 | A | 5/1956 | Thoma | |
| D206,915 | S | 2/1967 | Amburgey | |
| 3,355,069 | A | 11/1967 | Miles | |
| 4,170,724 | A * | 10/1979 | Waterbury | 220/270 |
| 5,086,941 | A | 2/1992 | English et al. | |
| 5,938,062 | A | 8/1999 | Paramski | |
| 5,996,887 | A * | 12/1999 | Cai et al. | 229/400 |
| 6,439,442 | B1 * | 8/2002 | Markert et al. | 222/547 |
| 6,824,003 | B1 | 11/2004 | Wong | |
| 6,929,143 | B2 * | 8/2005 | Mazzarolo | 220/254.3 |
| 2002/0011494 | A1 | 1/2002 | Lukacevic | |
| 2004/0256386 | A1 * | 12/2004 | LaFortune | 220/254.1 |
| 2006/0201945 | A1 * | 9/2006 | Tedford, Jr. | 220/254.9 |
| 2006/0255043 | A1 * | 11/2006 | Tedford, Jr. | 220/375 |
| 2008/0073347 | A1 * | 3/2008 | Shadrach | 220/254.9 |

FOREIGN PATENT DOCUMENTS

| | | |
|---|---|---|
| GB | 2 243 149 | 10/1991 |

* cited by examiner

*Primary Examiner*—Anthony Stashick
*Assistant Examiner*—Madison L Wright
(74) *Attorney, Agent, or Firm*—Dennison, Schultz & MacDonald

(57) ABSTRACT

A cup lid having a top panel with an upwardly projecting rim peripherally thereabout, a recessed channel in the top panel extends from a central area thereof to the rim, the channel having a bottom with a sipping opening defined therethrough adjacent the rim, a closure member selectively receivable in said channel for movement between open and closed positions relative to said opening, the closure member being integrally formed with said lid, or a companion cup, remote from said channel for selective severing therefrom and subsequent mounting within the channel.

16 Claims, 6 Drawing Sheets

CUP LID WITH SLIDE CLOSURE

BACKGROUND OF THE INVENTION

The present invention broadly relates to cup lids, and more particularly to hot cup lids of the type normally including a sipping hole or opening therethrough with means for selectively closing and opening the sipping hole.

Such lids, while not limited thereto, are usually formed of an appropriate thermoplastic or synthetic resinous material with the closure for the sipping opening comprising a separately formed slide member received within guides on the lid for sliding movement between the desired open and closed positions.

The prior art discloses many examples of such sliding closures, note for example Waterbury, U.S. Pat. No. 4,170,724, issued Oct. 9, 1979; Paramski, U.S. Pat. No. 5,938,062, issued Aug. 17, 1999; and Wong, U.S. Pat. No. 6,824,003 B1, issued Nov. 30, 2004.

In the prior art, the lid and sliding closure are separately formed or molded items which are necessarily also separately handled until assembled in operative relation with each other at the point of assembly. Thus, as a practical matter, whether at the manufacturer of the individual components or at the distributor, care must be taken to ensure that an equal number of lids and sliding closures be provided for assembly as a complete item. In other words, inventory control will necessarily involve not only an adequate number of lids for the number of cups to be supplied but also an adequate number of sliding closures for the number of lids.

SUMMARY OF THE INVENTION

Inasmuch as the lids and cups of the type with which the invention is concerned are disposable, that is after a single use are discarded, and as literally millions of such cups and lids are produced annually and disposed of after a single use, any saving to be obtained in the manufacture and distribution of such products would be of a potentially great economic advantage.

Accordingly, the object of the present invention is to provide a lid of the type including a slide closure which is both economical to manufacture and distribute, and which is particularly practical in both ease and manner of use. Pursuant thereto, and in accord with the preferred embodiment, the lid of the invention and the slide closure therefore are thermoformed or molded as a unit or single piece with the panel-like slide closure separable from the lid along a tear or severance line defined during the forming process. Thus, there is no necessity for the supplying of a separate closure member. Rather, each lid, as it is formed and supplied, is provided with its own closure member for use as desired by the consumer.

As a secondary embodiment, an assembly comprising a lid member and a cup member can provide for the sliding closure member as an extension integrally formed with the cup rather than with the lid. Such an extension, formed of the same material as the cup, will extend from one of the vertical seam edges of the cup with an appropriate break or tear line allowing for separation of the tab for use as the closure member on the associate lid. Inasmuch as the cup and lid will be presented to the consumer as a unit, the provision of the closure member on the cup would be a practical alternative to the formation of the closure member on the lid itself as in the primary embodiment. In each instance, the lid itself will be of the same basic construction capable of accommodating either form of closure member.

Further features, objects and advantages of the invention will become apparent from the more detailed description of the invention following hereinafter.

DETAILED DESCRIPTION OF PREFERRED EMBODIMENTS

Figure 1:
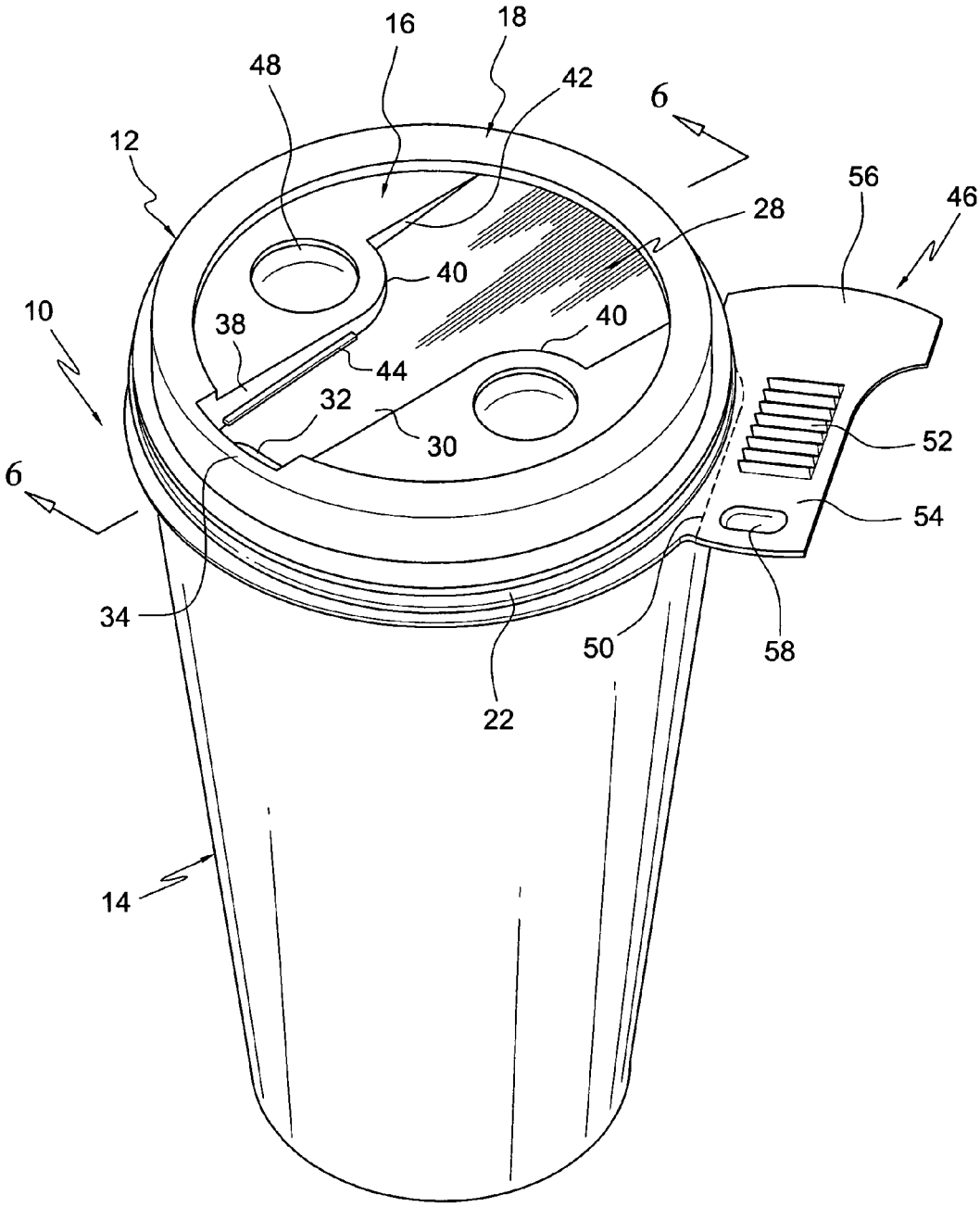
FIG. 1 is a perspective view of a lid and cup assembly illustrating the sliding closure as an integral part of the lid.
Figure 2:
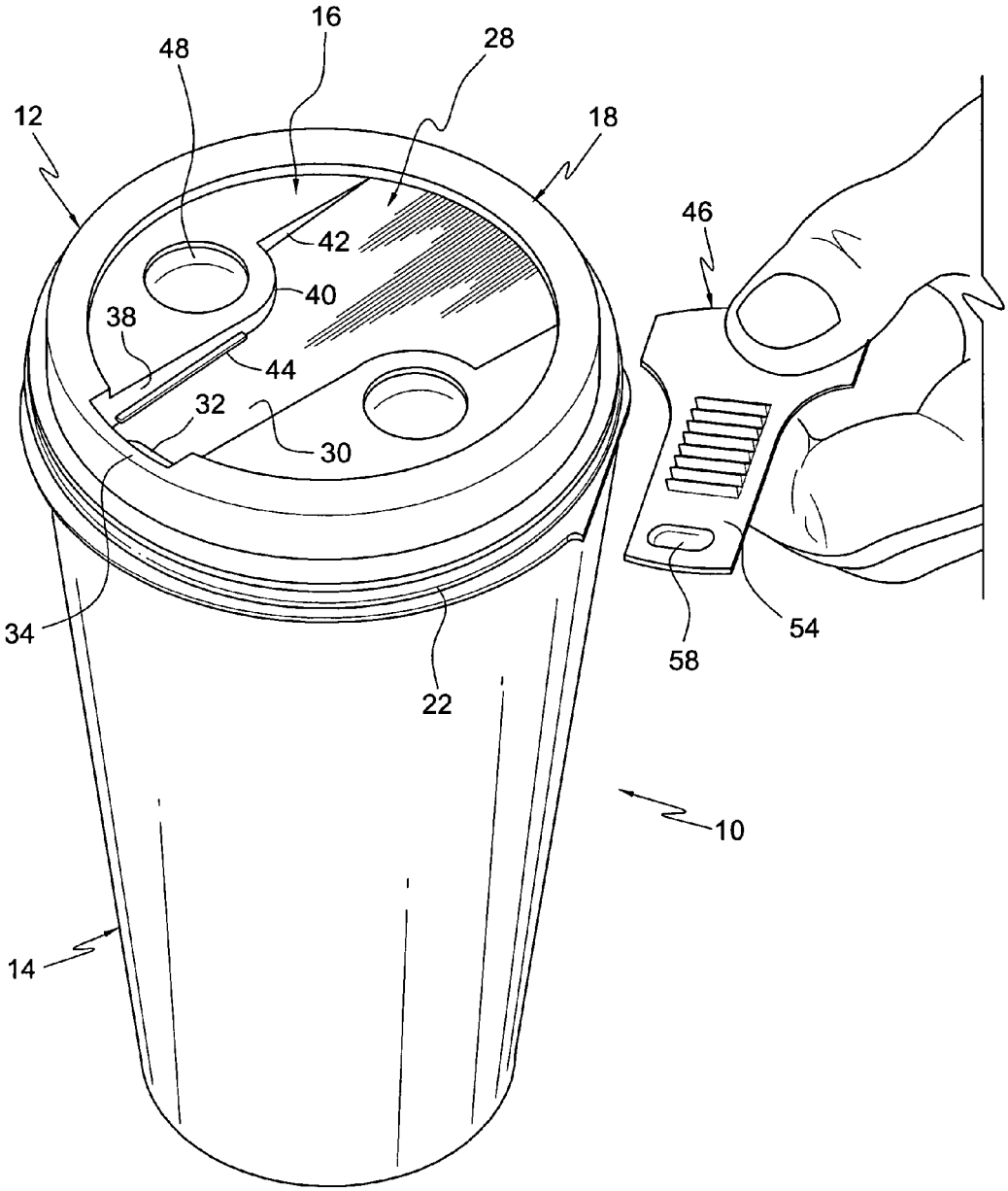
FIG. 2 is a view similar to FIG. 1 illustrating removal of the closure member.
Figure 3:
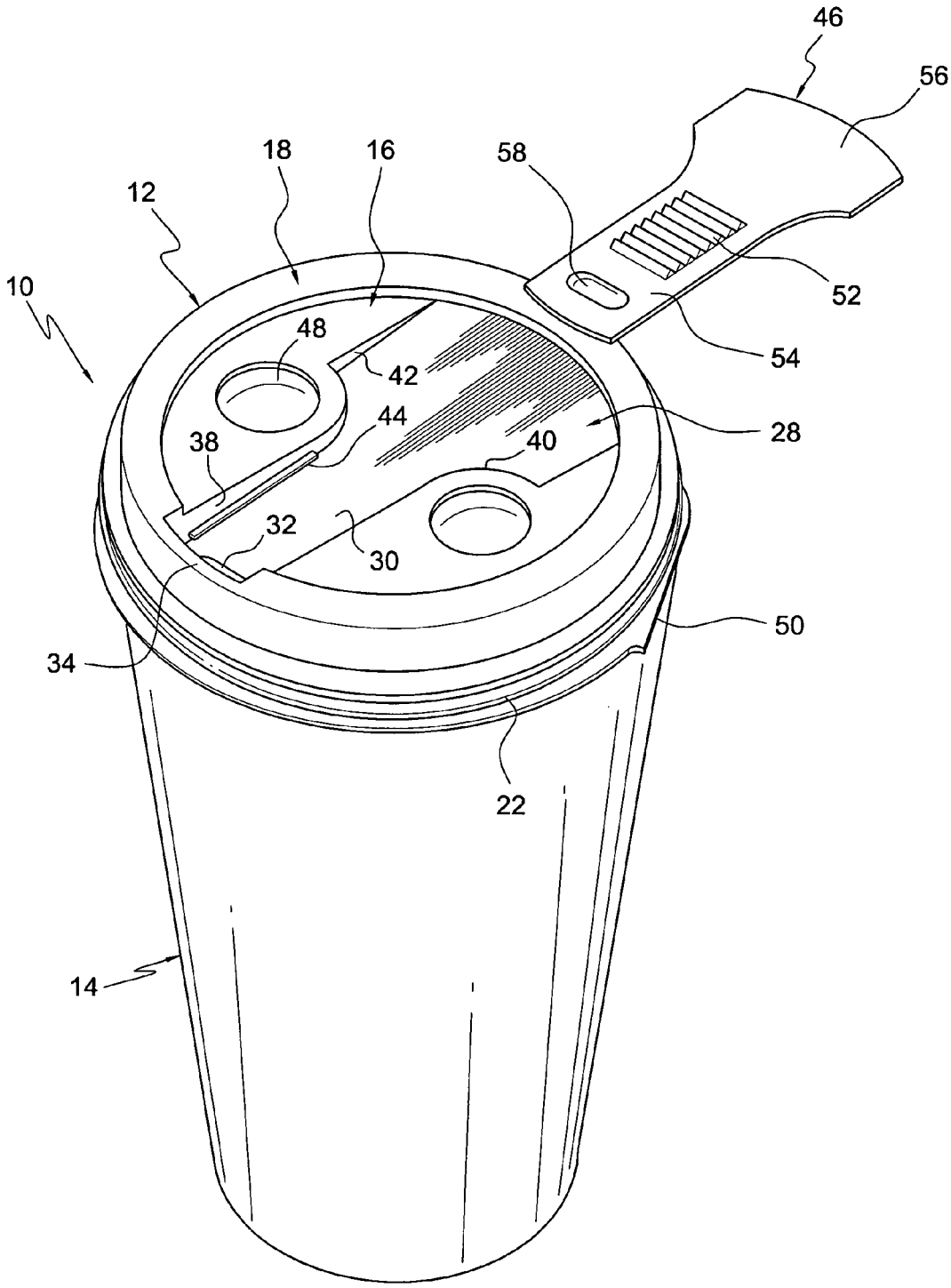
FIG. 3 illustrates the next sequential step of aligning the sliding closure with the lid channel for insertion therein.
Figure 4:
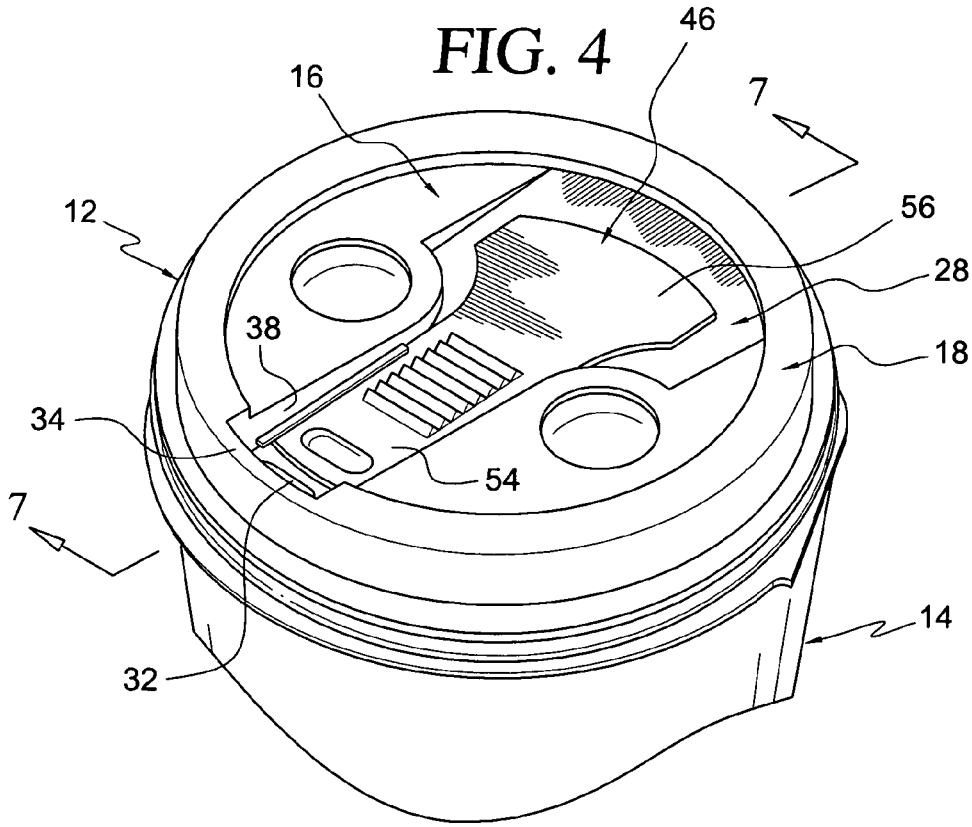
FIG. 4 is a perspective view of the lid with the closure in its mounted open position.
Figure 5:
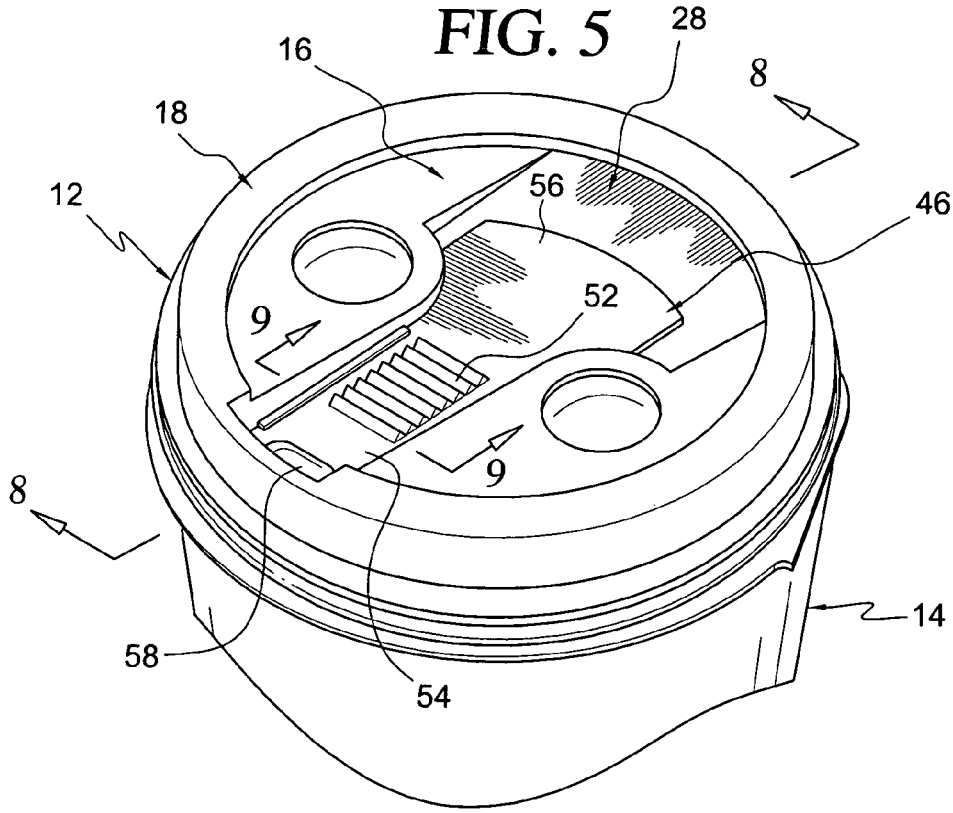
FIG. 5 is a view similar to FIG. 4 with the closure moved to its closed position.

The covered drink container 10 of the invention, noting FIG. 1 as an example, comprises two components, a lid 12 and a cup 14. The cup 14 is of a generally conventional construction, preferably formed of an appropriate plastic-coated cardboard material with a rolled or beaded upper edge to which the lid 12 will, through a snap-lock action, releasably seal.

Figure 6:
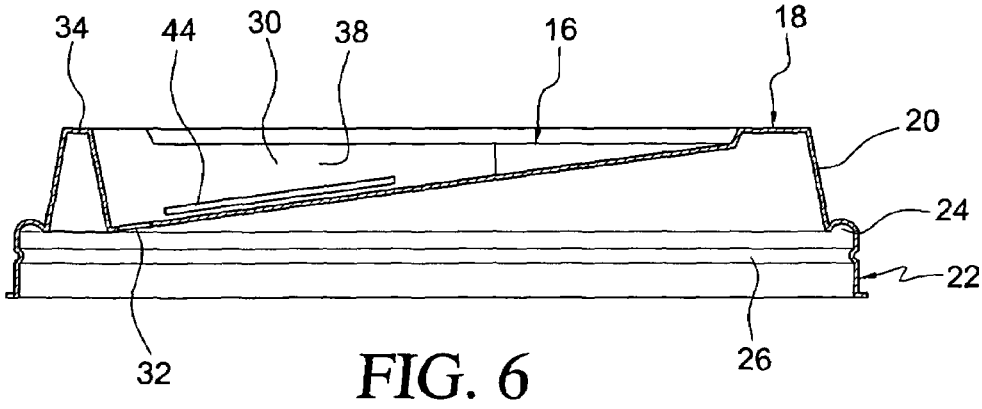
FIG. 6 is an enlarged cross-sectional detail taken substantially on a plane passing along line 6-6 in FIG. 1.
Figure 7:
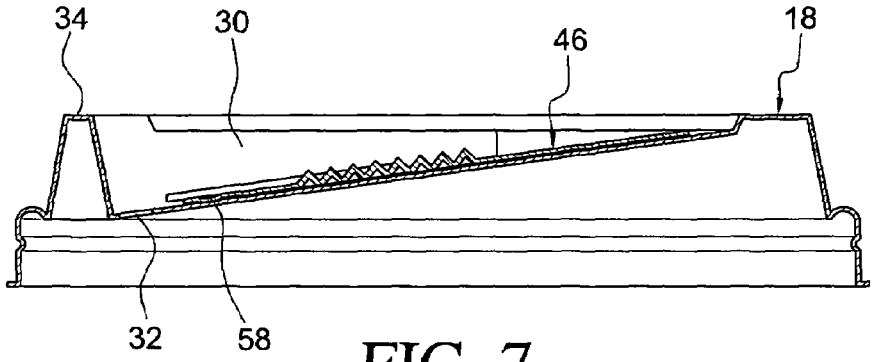
FIG. 7 is an enlarged cross-sectional detail taken substantially on a plane passing along line 7-7 in FIG. 4.
Figure 8:
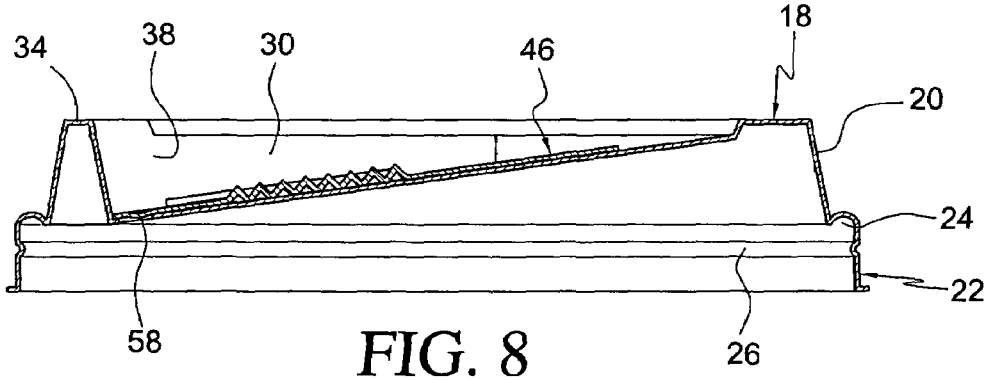
FIG. 8 is an enlarged cross-sectional detail taken substantially on a plane passing along line 8-8 in FIG. 5.

The lid 12 includes a top panel 16 surrounded by a raised flat-top rim 18 thereabout. Noting the cross-sectional details of FIGS. 6-8 in particular, a peripheral outer wall 20 depends from the top of the rim 18 at a slightly outwardly inclined angle and terminates at, and integrally joins, a depending skirt 22 adapted to engage to the beaded upper end of a cup. The skirt includes a downwardly directed cavity 24 and an inwardly directed rib 26 which, in an obvious manner, cooperates with the cavity 24 to retain and releasably seal the lid to the container.

A recess 28 is provided in the top panel 16 and extends transversely thereacross between aligned opposed sections of the rim 18. The recess 28 includes a forward portion forming an elongate channel 30 which extends for approximately one-half the length of the recess 28 and terminates at the rim 18. The bottom of the channel 30 at the rim has an opening 32, normally a sipping opening, therethrough. As will be appreciated from the drawings, in order to facilitate access to this sipping opening 32, the channel 30 will extend into the rim 18 for approximately one-half the width of the rim, thereby providing a narrow drinking lip 34 immediately above the opening 32.

The rear portion of the recess 28 that is relative to the opening 32 and channel 30, is substantially wider than the channel to facilitate access to the channel as shall be explained subsequently. The bottom of the recess, for the full length thereof to the opening 32, is inclined downwardly, as noted in the cross-sectional details, in order that the recess might accommodate any spillage or accumulation of liquid on the lid and direct this spillage into the cup through the opening 32.

The opposed side walls 38 of the channel 30, are progressively higher as the rim end of the channel is approached. These side walls, remote from the rim, each continue in an arc 40 as the channel side walls 38 join the progressively lower height side walls 42 of the wider portion of the recess 28.

Figure 9:
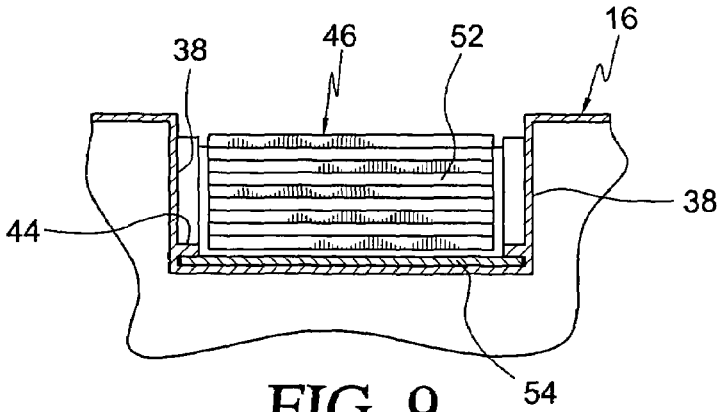
FIG. 9 is a transverse cross-sectional detail taken substantially on a plane passing alone line 9-9 in FIG. 5.

Noting FIG. 1 and the detail of FIG. 9 in particular, the opposed side walls 38 of the channel 30 include, slightly upwardly spaced from the channel bottom, inwardly directed guide ribs 44 which can be, as illustrated, narrow flanges integral with the side walls 38, inwardly projecting concave ribs defined directly from the side walls 38, or any other similar construction which cooperates with the bottom of the channel 40 to define a retaining tracks or guideways for slidably receiving a closure or closure member 46 mountable therein as shall be explained subsequently.

As desired, the lid 12 may be provided with depressible dimples 48 in the top panel 16 as a means for providing a visible indication of the container contents.

Noting FIG. 1 in particular, the closure or closure member 46 is formed or molded as an integral part of the lid 12 and extends laterally outward from the lower edge of the lid skirt 22. The closure 46 is severable from the lid, preferably by the customer, by a slight flexing of the closure 46 along a severance or tear line 50 provided during the forming of the lid. This breaking away of the closure 46 and the positioning thereof will be noted in the sequential views of FIGS. 2-5.

As illustrated, the closure 46 is basically a flat panel with a central roughened gripping area 52 to facilitate sliding movement of the closure 46, by a single finger, between an open position exposing the sipping opening 32 and a closed position wherein the opening is sealed by the closure member. The closure 46, for at least a substantial or major portion 54 of the length thereof, is of a width allowing for close guiding reception within the channel 30 of the lid with the opposed longitudinal edges of this portion 54 engaging within the guideways defined by the ribs 44 on the opposed side walls 38 of the channel 30. This relationship will be noted in the cross-sectional detail of FIG. 9. The rear portion 56 of the closure 46 is preferably transversely enlarged relative to the channel receiving portion 54 and seats within the larger portion of the recess 28. In this manner, the enlarged rear portion 56 will, upon engagement with the inner surface or wall of the rim 18, limit the retraction or opening sliding movement of the closure 46 and thus prevent accidental disengagement of the closure 46 from the lid 12. This wider rear portion 56 also tends to limit any sideward shifting, through engagement with the side walls 42 of the recess 28, as might misalign or disengage the channel receiving portion 54 relative to the channel 30. As will be appreciated, and noting FIGS. 3 and 4 in particular, the closure 46, while relatively stiff so as to appropriately slide within the channel 30 upon manipulation by a single finger of the user, has a sufficient degree of flexibility as to allow for a slight flexing along the length thereof as the leading or narrower portion 54 of the closure 46 is initially introduced into the channel 30 through the wider rear portion of the recess 28. Once the closure is mounted, accidental separation of the closure from the lid is substantially precluded.

In order to enhance the sealing of the opening 32 upon a forward sliding of the closure 46 over the opening, a slightly depressed lug or projection 58, conforming in configuration to the opening 32, is provided toward the leading end of the forward portion 54 of the closure 46. Noting FIG. 8, this projection 58 will, upon alignment with the opening 32, engage within and provide an effective sealing of the opening. Engaged in this manner, the projection 58 will also act as a detent which will tend to prevent an opening movement of the closure 46 within the channel in the absence of positive finger pressure. Thus, the projection 58 also acts as a safety feature preventing accidental opening of the sipping opening and the discharge of what could be very hot liquid.

Again noting FIG. 1, it will be seen that the closure or closure member 46 is formed on the periphery of the lid at approximately one-third the distance, or about a 120° away from the sipping opening 32. So positioned, and if the contents of the cup are to be immediately consumed, the sipping opening 32 is freely accessed without the necessity of removing the closure 46. In other words, the closure 46, in light of its remote location relative to the sipping opening 32 will not interfere with the direct access to the cup contents through the opening 32.

Figure 10:
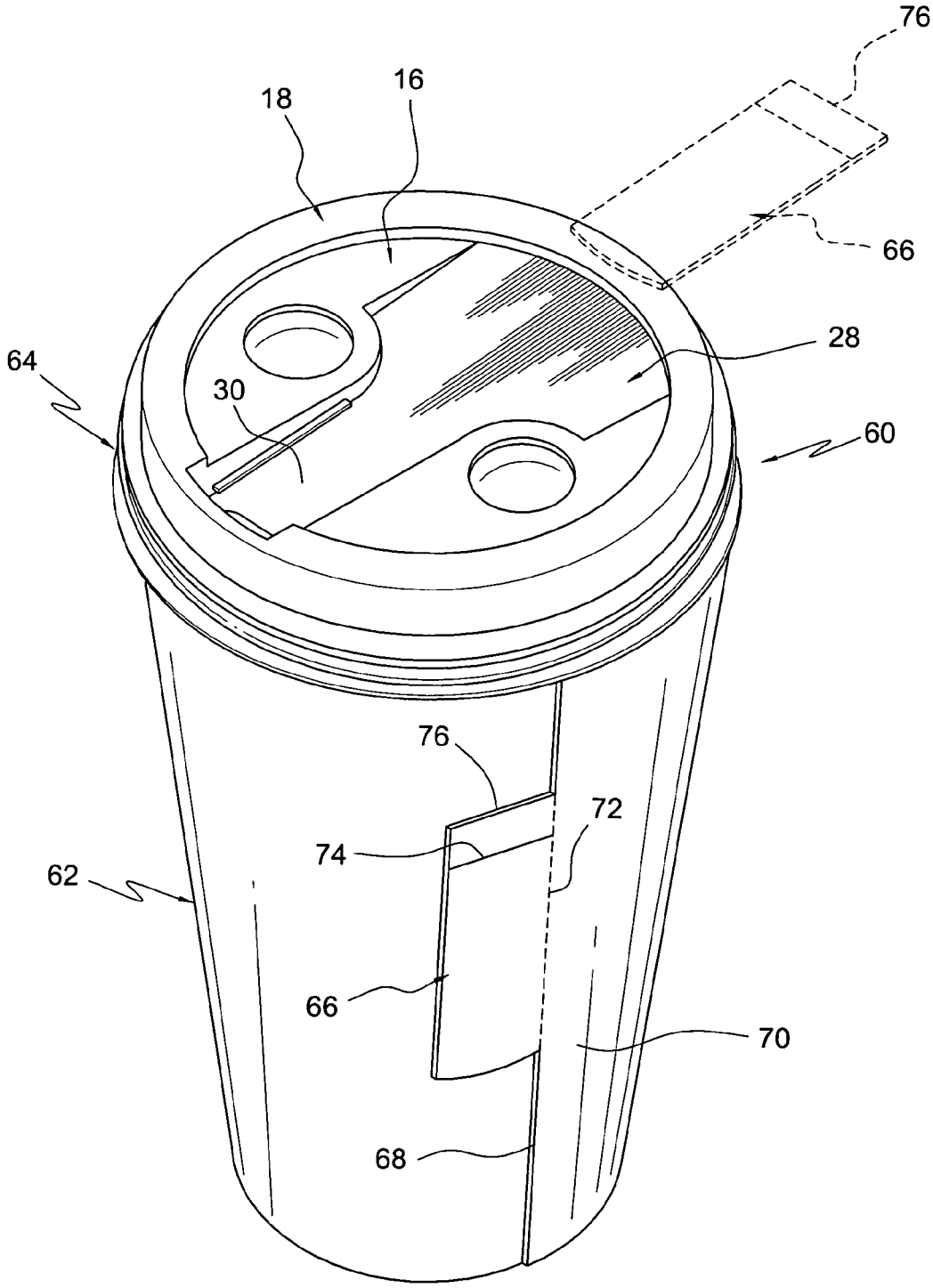
FIG. 10 illustrates an embodiment wherein the sliding closure is integrally formed with the cup, this figure also illustrating, in phantom lines, an alignment of the cup-formed closure with the lid channel.

Attention is now directed to FIG. 10 which illustrates a secondary embodiment comprising a drink container consisting of an assembly 60 of a cup component 62 and a lid component 64 provided as a unit as it would be presented to a customer upon a filling of the cup.

The lid component 64 differs from the previously detailed lid 12 only in the absence of the integral closure 46. To illustrate the similarities between lid 12 and lid component 64, the reference numerals applied to the major parts of the lid 12 have also been applied to these same parts appearing on the lid component 64.

As will be recognized from FIG. 10, the closure or closure member 66, which is to be slidably received and manipulated within the channel 30 of the lid 64, is formed as an integral extension of the outer edge 68 of the overlapping edge portions of the cup wall 70 which, in the manner of a conventional cup, are appropriately sealed to provide the desired container configuration. An appropriate severance or tear line 72 is provided separating the integral closure member 66 from edge 68 to allow for removal of the closure 66, as desired, from the cup wall edge 68. It will be appreciated that this closure 66, contrary to the edge 68, will not be secured to the underlying portion of the cup wall, and thus freely movable for separation along the tear line 72.

Once removed from the edge 68, and noting the phantom line showing, closure 66 is introduced into the lid channel 30 for use in the manner previously described. Incidentally, as the closure 66 is to be formed as an integral part of the container wall 70, the closure 66 will be of the same plastic coated cardboard material as the liquid-proof cup itself. As such, the closure 66 will also provide for a positive liquid barrier for the sipping opening 32 when closed thereover. While not illustrated, the closure 66 can also be provided with a slight dimple therein corresponding to the projection 58 on the initially described closure 46. Also, as illustrated, the closure 66 can be provided with a transverse fold line 74 slightly inward from the rear edge 76 thereof to allow for an upward angling of this rear portion to facilitate engagement with the closure 66 for sliding movement thereof.

It will be recognized that as the cup and lid will always be presented to the customer as a unit, the customer will always have access to a closure for use, as desired, on the lid.

The foregoing is considered illustrative of the principles of the invention. As modifications and variations may occur to those skilled in the art, it is not desired to limit the invention to the exact construction and manner of use as shown and described. Rather, all suitable modifications and equivalents may be resorted to as falling within the scope of the invention as claimed.

The invention claimed is:

1. A cup lid comprising a top panel, a rim integral with and peripherally about said panel, a channel in said top panel extending from a central area thereon to said rim, said channel having a bottom, an opening defined through said bottom adjacent said rim, a recess in said top panel, said recess having a greater width than said channel and extending from said channel at said central area to said rim, said recess having a bottom coplanar with said channel bottom, said recess bottom and said channel bottom inclining slightly downward toward said opening in said channel bottom, a closure member for said opening integrally formed with said lid, a tear line defined between said closure member and said lid for a severing of said closure member from said lid, said channel including means for slidably receiving and retaining said closure member, subsequent to a severing of said closure member from said lid, for sliding movement in said channel between a closed position wherein said closure member overlies and closes said opening and an open position wherein said opening is exposed for a sipping of a cup's contents therethrough.

2. The cup lid of claim 1 wherein said means for retaining said closure member for sliding movement in said channel comprises a pair of opposed guideways along opposed sides of said channel for receiving opposed side edge portions of the severed closure member.

3. The cup lid of claim 2 including a depending skirt peripherally about said lid outward of said rim, said closure member, prior to severing, being integrally formed with said skirt.

4. The cup lid of claim 3 wherein said closure member includes a gripping surface thereon for facilitating manual sliding movement of said closure member within said channel.

5. The cup lid of claim 4 wherein said closure member, adjacent a leading end thereof, includes a projection conforming in shape and size to said opening for engagement in and sealing of said opening in said closed position of the channel received closure.

6. The cup lid of claim 1 wherein said closure member includes a gripping surface defined thereon for facilitating manual sliding movement of said closure member within said channel.

7. The cup lid of claim 6 wherein said closure member, adjacent a leading end thereof, including a projection conforming in shape and size to said opening for engagement in and sealing of said opening in said closed position of the channel received closure.

8. A formed lid for a hot cup comprising a top panel, said top panel having an outer periphery with means on said outer periphery for a mounting of said lid to a cup, said top panel having a channel defined therein and extending from a central area thereon to a point adjacent the periphery of the top panel, said channel having a bottom, an opening defined through said bottom adjacent said periphery, a recess in said top panel, said recess having a greater width than said channel and extending from said channel at said central area to said rim, said recess having a bottom coplanar with said channel bottom, said recess bottom and said channel bottom inclining slightly downward toward said opening in said channel bottom, a closure member for said opening integrally formed with said lid remote from said channel, a severance line defined between said closure member and said lid for a severing of said closure member from said lid, said channel being of a size as to slidably receive the severed closure member, said channel including means for slidably retaining said closure member therein for movement between a closed position overlying said opening and an open position wherein said closure member is retracted from said opening.

9. The cup lid of claim 8 wherein said means for a mounting of the lid to a cup includes a depending peripheral skirt.

10. The cup lid of claim 9 wherein said closure member is integrally formed with said skirt and extends laterally therefrom prior to severing.

11. The cup lid of claim 10 including an upwardly projecting rim defined peripherally about said top panel immediately inward of said skirt.

12. The cup lid of claim 11 wherein said channel extends partially into said rim and defines a narrowing of said rim to form a drinking lip adjacent the opening in the bottom of the channel.

13. A closable drink container for receiving and selectively discharging a liquid, said container comprising a lid component and a cup component, said lid component comprising a top panel, having an outer periphery, a channel defined in said top panel extending from a central area thereon to a point adjacent said periphery, said channel having a bottom, an opening defined through said bottom adjacent said periphery, a recess in said top panel, said recess having a greater width than said channel and extending from said channel at said central area to said rim, said recess having a bottom coplanar with said channel bottom, said recess bottom and said channel bottom inclining slightly downward toward said opening in said channel bottom, a closure member for said opening integrally formed with one of said lid and cup components, a severance line defined between said closure and the component with which said closure component is integrally formed for a selective severing of the closure member, said channel including means for slidably receiving and retaining the severed closure member for sliding movement in said channel between a closed position overlying said opening and an open position withdrawn therefrom.

14. The closable drink container of claim 13 wherein said closure member is integral with and extends beyond a seam forming edge on said cup component.

15. The closable drink container of claim 13 wherein said closure member is integrally formed with said lid component remote from said channel.

16. The closable drink container of claim 15 including means for a mounting of the lid component to a cup component including a depending peripheral skirt, said closure member being integrally formed with said skirt and extending laterally therefrom prior to severing.

* * * * *